US007036316B2

(12) United States Patent
Howell et al.

(10) Patent No.: US 7,036,316 B2
(45) Date of Patent: May 2, 2006

(54) METHODS AND APPARATUS FOR COOLING TURBINE ENGINE COMBUSTOR EXIT TEMPERATURES

(75) Inventors: Stephen John Howell, West Newbury, MA (US); Allen Michael Danis, Mason, OH (US)

(73) Assignee: General Electric Company, Schenetady, NY (US)

( * ) Notice: Subject to any disclaimer, the term of this patent is extended or adjusted under 35 U.S.C. 154(b) by 229 days.

(21) Appl. No.: 10/687,683

(22) Filed: Oct. 17, 2003

(65) Prior Publication Data

US 2005/0081526 A1 Apr. 21, 2005

(51) Int. Cl.
*F23R 3/04* (2006.01)

(52) U.S. Cl. ..... 60/772; 60/754; 60/755

(58) Field of Classification Search ..... 60/722, 60/752, 754, 755, 772
See application file for complete search history.

(56) References Cited

U.S. PATENT DOCUMENTS

| | | | | |
|---|---|---|---|---|
| 4,567,730 | A | 2/1986 | Scott | |
| 4,950,129 | A | 8/1990 | Patel et al. | |
| 5,222,360 | A | 6/1993 | Antuna et al. | |
| 5,228,828 | A | 7/1993 | Damlis et al. | |
| 5,273,396 | A | 12/1993 | Albrecht et al. | |
| 5,281,085 | A | 1/1994 | Lenahan et al. | |
| 5,820,024 | A | 10/1998 | Ausdenmoore et al. | |
| 5,911,679 | A | 6/1999 | Farrell et al. | |
| 6,045,325 | A | 4/2000 | Horvath et al. | |
| 2002/0116929 | A1* | 8/2002 | Snyder | 60/752 |
| 2003/0213250 | A1* | 11/2003 | Pacheco-Tougas et al. | 60/752 |
| 2004/0250548 | A1* | 12/2004 | Howell et al. | 60/796 |
| 2004/0261419 | A1* | 12/2004 | McCaffrey et al. | 60/752 |

FOREIGN PATENT DOCUMENTS

| | | | |
|---|---|---|---|
| EP | 110487 | A1 | 6/2001 |
| GB | 2125950 | A | 3/1984 |

* cited by examiner

*Primary Examiner*—Louis J. Casaregola
(74) *Attorney, Agent, or Firm*—William Scott Andes; Armstrong Teasdale LLP

(57) ABSTRACT

A method facilitates assembling a combustor for a gas turbine engine. The method comprises coupling an inner liner to an outer liner such that a combustion chamber is defined therebetween, positioning an outer support a distance radially outward from the outer liner, and positioning an inner support a distance radially inward from the inner liner. The method also comprises forming at least two rows of impingement openings extending through at least one of the inner support and the outer support for channeling impingement cooling air therethrough towards at least one of the inner liner and the outer liner, and forming at least one row of dilution openings extending through at least one of the inner liner and the outer liner for channeling dilution cooling air therethrough into the combustion chamber

18 Claims, 4 Drawing Sheets

METHODS AND APPARATUS FOR COOLING TURBINE ENGINE COMBUSTOR EXIT TEMPERATURES

STATEMENT REGARDING FEDERALLY SPONSORED RESEARCH OR DEVELOPMENT

The U.S. Government may have certain rights in this invention pursuant to contract number DAAE07-00-C-N086.

BACKGROUND OF THE INVENTION

This invention relates generally to gas turbine engines, more particularly to combustors used with gas turbine engines.

Known turbine engines include a compressor for compressing air which is suitably mixed with a fuel and channeled to a combustor wherein the mixture is ignited for generating hot combustion gases. At least some known combustors include an inner liner that is coupled to an outer liner such that a combustion chamber is defined therebetween. Additionally, an outer support is coupled radially outward from the outer liner such that an outer cooling passage is defined therebetween, and an inner support is coupled radially inward from the inner liner such that an inner cooling passage is defined therebetween.

Within at least some known recuperated gas turbine engines, cooling requirements of turbines may create a pattern factor requirement at the combustor that may be difficult to achieve because of combustor design characteristics associated with recuperated gas turbine engines. More specifically, because of space considerations, such combustors may be shorter than other known gas turbine engine combustors. In addition, in comparison to other known gas turbine combustors, such combustors may include a steeply angled flowpath and large fuel injector spacing.

Accordingly, at least some known combustors include a dilution pattern of a single row of dilution jets to facilitate controlling the combustor exit temperatures. The dilution jets are supplied cooling air from an impingement array of openings extending through the inner and outer supports. However, because of cooling considerations downstream from the combustor and because of the limited number and relative orientation of such impingement and dilution openings, such combustors may only receive only limited dilution air from such openings.

BRIEF DESCRIPTION OF THE INVENTION

In one aspect, a method for assembling a combustor for a gas turbine engine is provided. The method comprises coupling an inner liner to an outer liner such that a combustion chamber is defined therebetween, positioning an outer support a distance radially outward from the outer liner, and positioning an inner support a distance radially inward from the inner liner. The method also comprises forming at least two rows of impingement openings extending through at least one of the inner support and the outer support for channeling impingement cooling air therethrough towards at least one of the inner liner and the outer liner, and forming at least one row of dilution openings extending through at least one of the inner liner and the outer liner for channeling dilution air therethrough into the combustion chamber.

In another aspect, a combustor for a gas turbine engine is provided. The combustor includes an inner liner, an outer liner, an outer support, and an inner support. The outer liner is coupled to the inner liner to define a combustion chamber therebetween. The outer support is radially outward from the outer liner such that an outer passageway is defined between the outer support and the outer liner. The inner support is radially inward from the inner liner such that an inner passageway is defined between the inner support and the inner liner. At least one of the inner support and the outer support includes at least two rows of impingement openings arranged in an array and extending therethrough for channeling impingement cooling air towards at least one of the inner liner and the outer liner. At least one of the inner liner and the outer liner includes at least one row of dilution openings extending therethrough for channeling dilution air into the combustion chamber.

In a further aspect, a gas turbine engine including a combustor is provided. The combustor includes at least one injector, an inner liner, an outer liner, an outer support, and an inner support. The inner liner is coupled to the outer liner to define a combustion chamber therebetween. The inner and outer liners further define an injector opening, and the injector extends substantially concentrically through the injector opening. The outer support is spaced radially outward from the outer liner. The inner support is spaced radially inward from the inner liner. At least one of the inner support and the outer support includes at least two rows of impingement openings arranged in an array and extending therethrough for channeling impingement cooling air towards at least one of the inner liner and the outer liner. At least one of the inner liner and the outer liner includes at least one row of dilution openings extending therethrough for channeling dilution air into the combustion chamber.

DETAILED DESCRIPTION OF THE INVENTION

Figure 1:
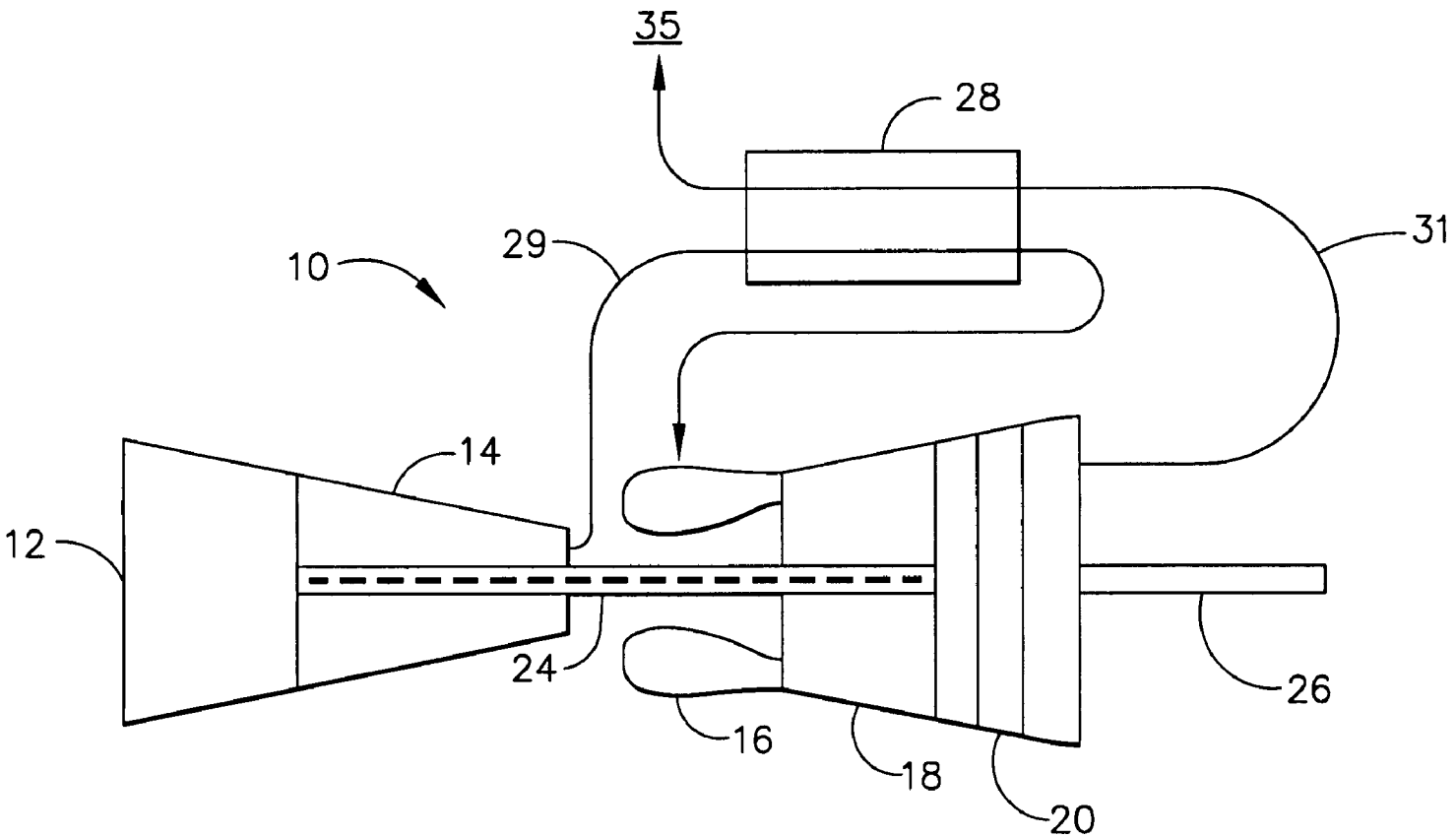
FIG. 1 is a schematic of a gas turbine engine.

FIG. 1 is a schematic illustration of a gas turbine engine 10 including a compressor 14, and a combustor 16. Engine 10 also includes a high pressure turbine 18 and a low pressure turbine 20. Compressor 14 and turbine 18 are coupled by a first shaft 24, and turbine 20 drives a second output shaft 26. Shaft 26 provides a rotary motive force to drive a driven machine, such as, but, not limited to a gearbox, a transmission, a generator, a fan, or a pump. Engine 10 also includes a recuperator 28 that has a first fluid path 29 coupled serially between compressor 14 and combustor 16, and a second fluid path 31 that is serially coupled between turbine 20 and ambient 35. In one embodiment, the gas turbine engine is an LV100 engine available from General Electric Company, Cincinnati, Ohio. In the exemplary embodiment, compressor 14 is coupled by a first shaft 24 to turbine 18, and powertrain and turbine 20 are coupled by a second shaft 26.

In operation, air flows through high pressure compressor 14. The highly compressed air is delivered to recuperator 28 where hot exhaust gases from turbine 20 transfer heat to the compressed air. The heated compressed air is delivered to combustor 16. Airflow from combustor 16 drives turbines 18 and 20 and passes through recouperator 28 before exiting gas turbine engine 10. In the exemplary embodiment, during operation, air flows through compressor 14, and the highly compressed recuperated air is delivered to combustor 16.

Figure 2:
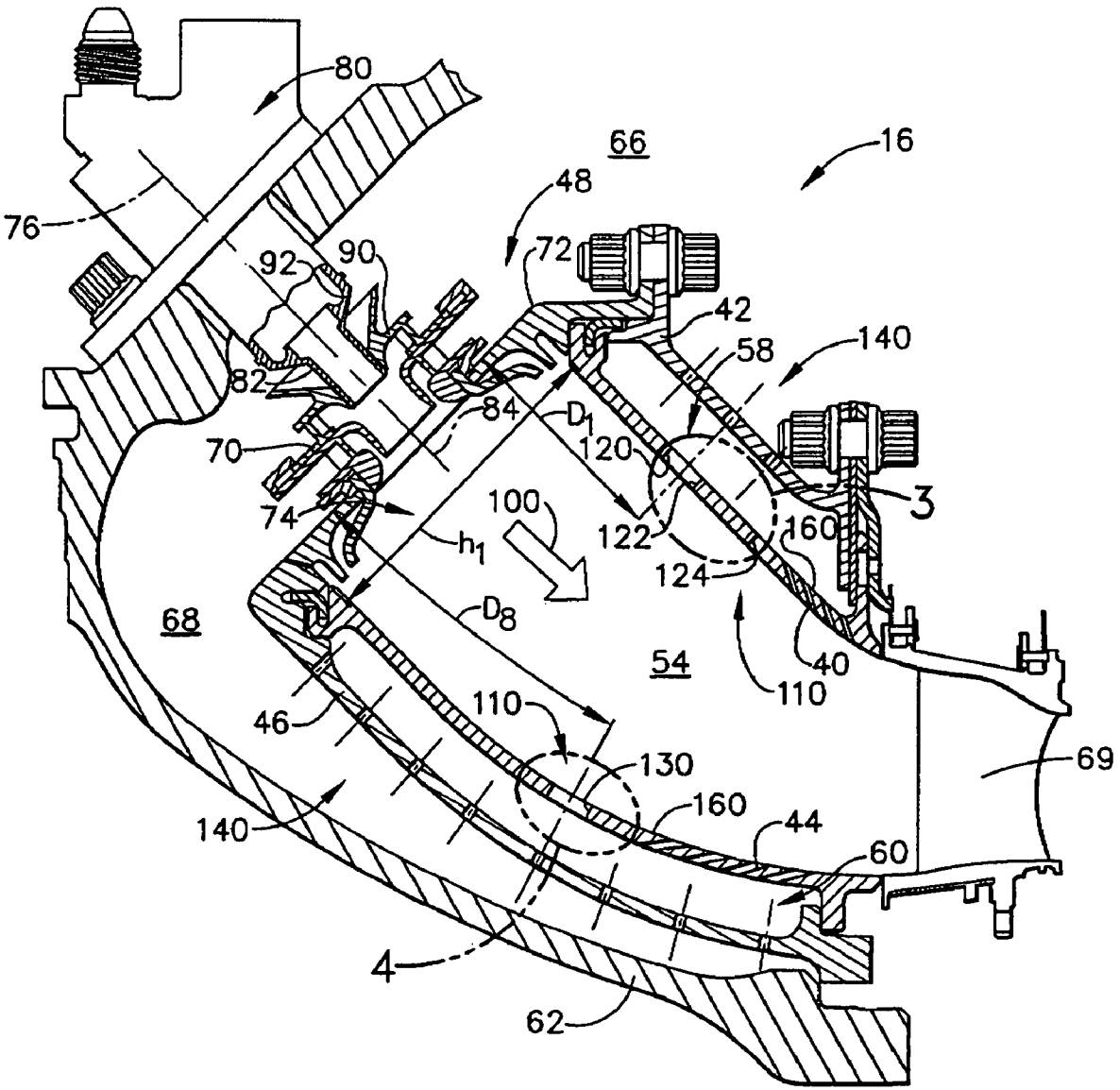
FIG. 2 is a cross-sectional illustration of a portion of an annular combustor used with the gas turbine engine shown in FIG. 1.
Figure 3:
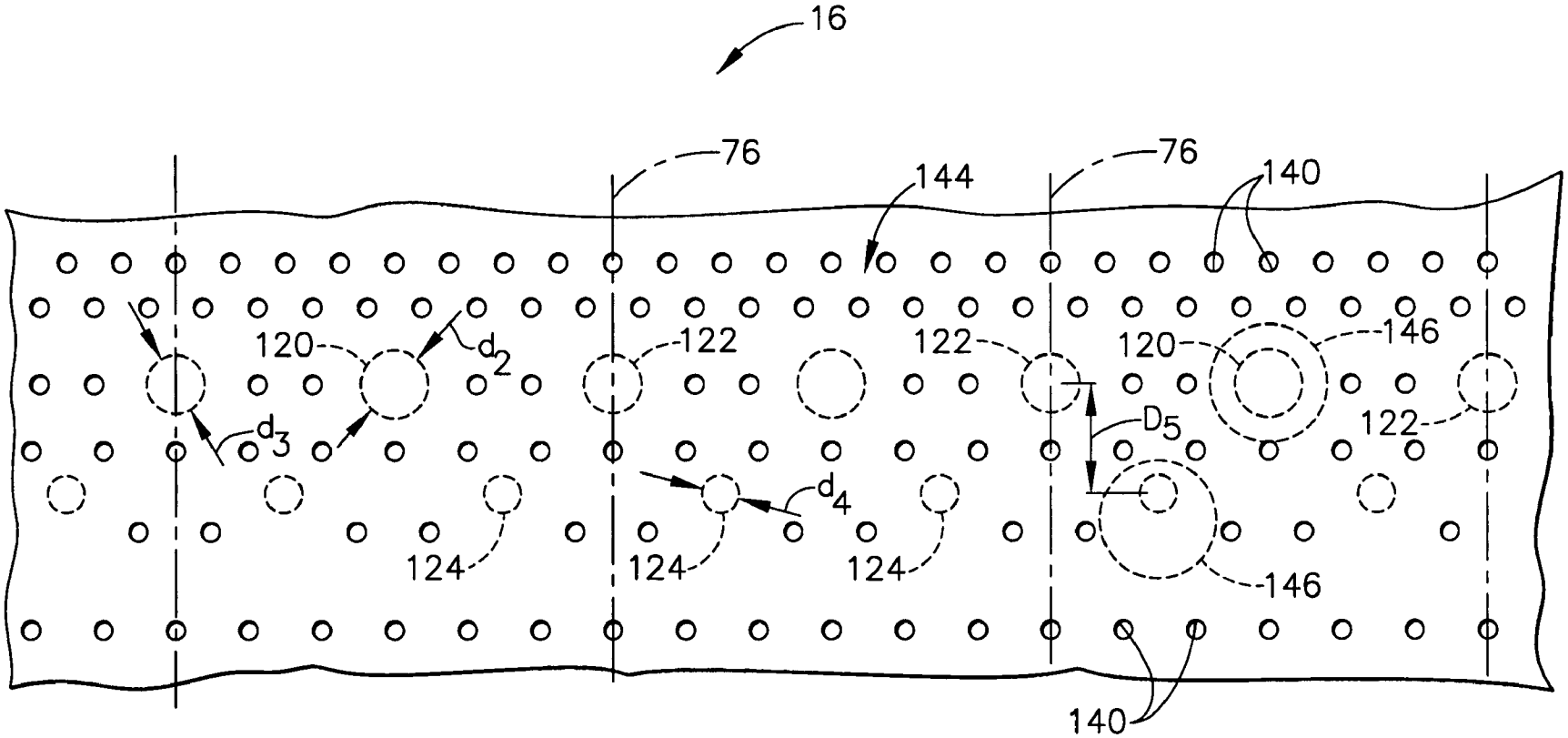
FIG. 3 is a roll-out schematic view of a portion of the combustor shown in FIG. 2 and taken along area 3.
Figure 4:
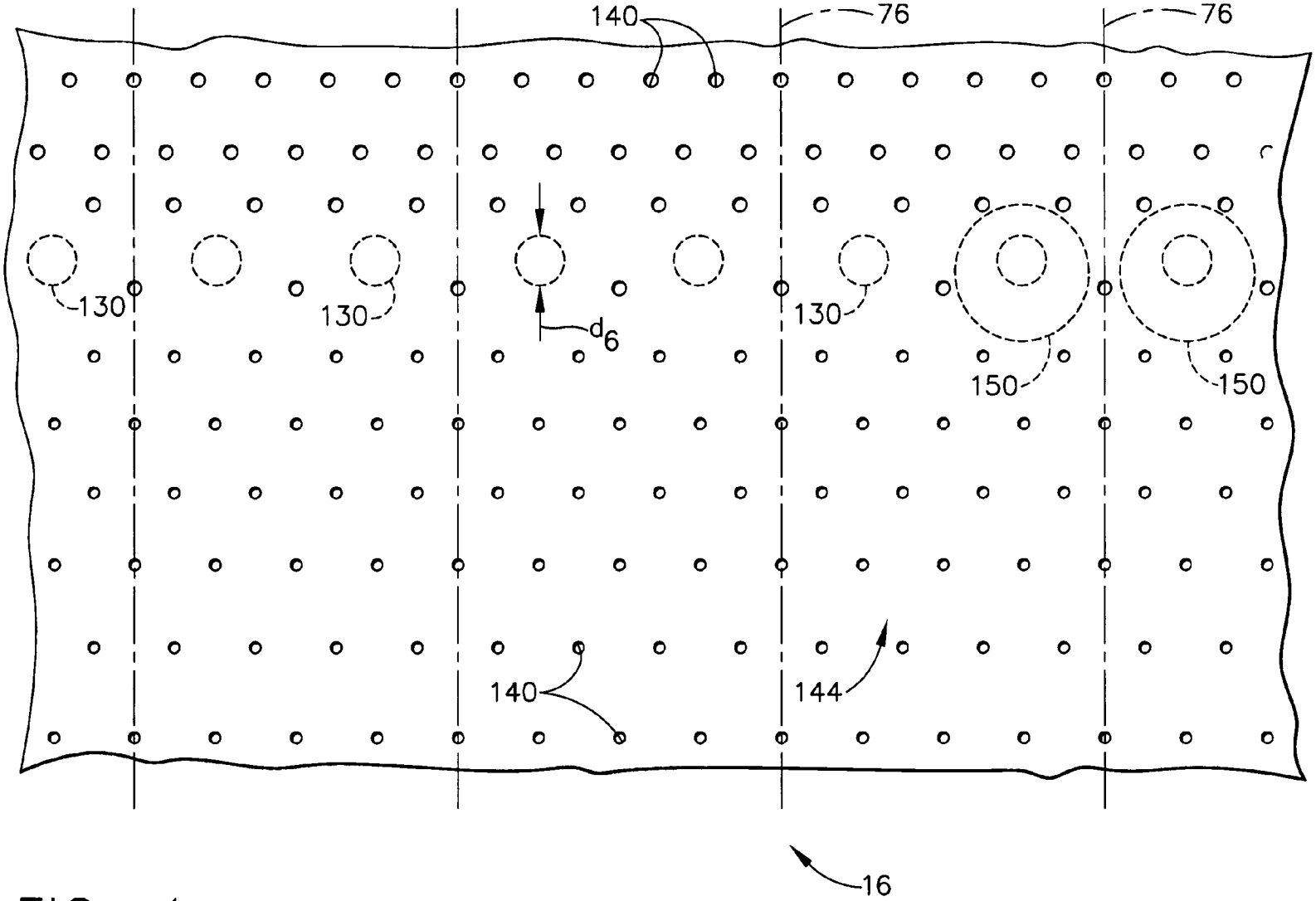
FIG. 4 is a roll-out schematic view of a portion of the combustor shown in FIG. 2 and taken along area 4.

FIG. 2 is a cross-sectional illustration of a portion of an annular combustor 16. FIG. 3 is a roll-out schematic view of a portion of combustor 16 and taken along area 3 (shown in FIG. 2). FIG. 4 is a roll-out schematic view of a portion of combustor 16 and taken along area 4 (shown in FIG. 2). Combustor 16 includes an annular outer liner 40, an outer support 42, an annular inner liner 44, an inner support 46, and a dome 48 that extends between outer and inner liners 40 and 44, respectively.

Outer liner 40 and inner liner 44 extend downstream from dome 48 and define a combustion chamber 54 therebetween. Combustion chamber 54 is annular and is spaced radially inward between liners 40 and 44. Outer support 42 is coupled to outer liner 40 and extends downstream from dome 48. Moreover, outer support 42 is spaced radially outward from outer liner 40 such that an outer cooling passageway 58 is defined therebetween. Inner support 46 also is coupled to, and extends downstream from, dome 48. Inner support 46 is spaced radially inward from inner liner 44 such that an inner cooling passageway 60 is defined therebetween.

Outer support 42 and inner support 46 are spaced radially within a combustor casing 62. Combustor casing 62 is generally annular and extends around combustor 16. More specifically, outer support 42 and combustor casing 62 define an outer passageway 66 and inner support 46 and combustor casing 62 define an inner passageway 68. Outer and inner liners 40 and 44 extend to a turbine nozzle 69 that is downstream from liners 40 and 44.

Combustor 16 also includes a dome assembly 70 which includes an air swirler 90. Specifically, air swirler 90 extends radially outwardly and upstream from a dome plate 72 to facilitate atomizing and distributing fuel from a fuel nozzle 82. When fuel nozzle 82 is coupled to combustor 16, nozzle 82 circumferentially contacts air swirler 90 to facilitate minimizing leakage to combustion chamber 54 between nozzle 82 and air swirler 90.

Combustor dome plate 72 is mounted upstream from outer and inner liners 40 and 44, respectively. Dome plate 72 contains a plurality of circumferentially spaced air swirlers 90 that extend through dome plate 72 into combustion chamber 54 and each include a center longitudinal axis of symmetry 76 that extends therethrough. Fuel is supplied to combustor 16 through a fuel injection assembly 80 that includes a plurality of circumferentially-spaced fuel nozzles 82 that extend through air swirlers 90 into combustion chamber 54. More specifically, fuel injection assembly 80 is coupled to combustor 16 such that each fuel nozzle 82 is substantially concentrically aligned with respect to air swirlers 90, and such that nozzle 82 extends downstream into air swirler 90. Accordingly, a centerline 84 extending through each fuel nozzle 82 is substantially co-linear with respect to air swirler axis of symmetry 76.

Because of the steeply angled flowpath 100 defined within combustor 16, circumferential spacing between adjacent fuel nozzles 82 and air swirlers 90, and downstream component cooling requirements, combustion gases generated within combustor 16 are cooled prior to being discharged from combustor 16 to enable combustor 16 to maintain a pre-determined pattern factor. Combustor pattern factor is generally defined as:

$$PF=(T4_{peak}-T4_{avg})/(T4_{avg}-T35)$$

where T4 refers to the combustor exit temperature, T35 refers to the combustor inlet temperature, and $T4_{peak}$ refers to the maximum temperature measured, and $T4_{avg}$. refers to the average of the temperatures measured. Pattern factor is a measure of the distortion in combustor exit temperature and generally, a lower value is more desirable.

Accordingly, combustor outer and inner liners 40 and 44, each include a plurality of dilution jets 110 to facilitate locally cooling combustion gases generated within combustion chamber 54, and to provide radial and circumferential exit temperature distribution. In the exemplary embodiment, dilution jets 110 are substantially circular and extend through liners 40 and 44. More specifically, outer liner 40 includes a plurality of primary larger diameter dilution openings 120, a plurality of smaller diameter dilution openings 122, and a plurality of secondary dilution openings 124. Openings 120, 122, and 124 extend circumferentially around combustor 16.

Smaller diameter outer primary dilution openings 122 are positioned substantially axially downstream with respect to air swirler centerline 76 at pre-determined distances $D_1$ downstream from dome 72. More specifically, in the exemplary embodiment, smaller outer primary dilution openings 122 are positioned downstream from dome plate 72 at a distance $D_1$ that is approximately equal 0.65 combustor passage heights $h_1$. Combustor passage heights $h_1$ is defined as the measured distance between outer and inner liners 40 and 44 at combustor chamber upstream end 74.

Larger diameter outer primary dilution openings 120 have a larger diameter $d_2$ than a diameter $d_3$ of smaller diameter outer primary dilution openings 122, and are positioned between adjacent air swirlers 90 at the same axial locations as openings 122. In one embodiment, larger diameter openings 120 have a diameter $d_2$ that is approximately equal 0.307 inches, and smaller diameter openings 122 have a diameter $d_3$ that is approximately equal 0.243 inches. Accordingly, each opening 120 is between a pair of circumferentially adjacent openings 122.

Outer secondary dilution openings 124 each have a diameter $d_4$ that is smaller than that of openings 120 and 122, and are each located at a predetermined axial distance $D_5$ aft of openings 120 and 122. In one embodiment, openings 124 have a diameter $d_{4\ that\ is\ approximately\ equal}$ 0.168 inches. More specifically, in the exemplary embodiment, openings 124 are approximately 0.25 passage heights $h_1$ downstream from openings 120 and 122. In addition, each secondary dilution opening 124 is positioned downstream from, and between, a pair of circumferentially adjacent primary dilution openings 120 and 122.

Inner liner 44 also includes a plurality of dilution jets 110 extending therethrough. More specifically, inner liner 44 includes a plurality of inner primary dilution openings 130 which each have a diameter $d_6$ that is smaller than a diameter $d_2$ and $d_3$ of respective outer primary dilution openings 120 and 122. In one embodiment, openings 130 have a diameter $d_6$ that is approximately equal 0.228 inches. Each inner primary dilution opening 130 is circumferentially aligned with each outer secondary dilution opening 124 and between adjacent outer primary dilution openings 120 and 122. More specifically, in the exemplary embodiment, inner primary dilution openings 130 are positioned downstream from dome plate 72 at a distance $D_8$ that is approximately equal 0.70 combustor passage heights $h_1$. Accordingly, because primary dilution jets 120 and 122, and 130 are not opposed, enhanced mixing and enhanced circumferential coverage is obtained between dilution jets 110 and mainstream combustor flow. Accordingly, the enhanced mixing facilitates reducing combustor exit temperature distortion and, thus reduces pattern factor.

A number of dilution jets 110 is variably selected to facilitate achieving a desired radial and circumferential exit temperature distribution from combustor 16. More specifically, combustor 16 includes an equal number of outer primary dilution openings 120 and 122, outer secondary dilution openings 124, and inner primary dilution openings 130. In the exemplary embodiment, combustor 16 includes eighteen larger diameter outer primary dilution openings 120, eighteen smaller diameter outer primary dilution openings 122, and thirty-six inner primary dilution openings 130. More specifically, the number of outer primary dilution openings 120 and 122, outer secondary dilution openings 124 is selected to be twice the number of fuel injectors 82 fueling combustor 16.

Outer primary dilution openings 120 and 122, and outer secondary dilution openings 124 receive air discharged through impingement openings or jets 140 formed within outer support 42. Specifically, openings 140 are arranged in an array 144 that facilitates maximizing the cooling airflow available for impingement cooling of outer liner 40. Within array 144, openings 140 extend circumferentially around outer support 42, but do not extend into pre-designated interruption areas 146 defined across outer support 42. More specifically, each interruption area 146 is formed radially outward from outer primary dilution openings 120 and 122, and outer secondary dilution openings 124 to facilitate avoiding variable interaction between impingement and dilution jets 140 and 110, respectively, either by entrainment or by ejector effect.

Similarly, inner primary dilution openings 130 receive air discharged through impingement jets or openings 140 formed within inner support 46. Specifically, opening array 144 facilitates maximizing the cooling airflow available for impingement cooling of inner liner 44. Within array 144, openings 140 extend circumferentially across inner support 46, but do not extend into pre-designated interruption areas 150 defined across support 46. More specifically, each interruption area 150 is formed radially outward from inner primary dilution openings 130 to facilitate avoiding variable interaction between impingement and dilution jets 140 and 110, respectively, either by entrainment or by ejector effect.

Impingement jets 140 also supply airflow to multi-hole film cooling openings 160 formed within outer and inner liners 40 and 44, respectively. More specifically, openings 160 are oriented to discharge cooling air therethrough for film cooling liners 40 and 44. Accordingly, the number of impingement jets 140 is selected to facilitate maximizing the amount of cooling airflow supplied to liners 40 and 44. In the exemplary embodiment, the number of impingement jets 140 is a multiple of the number of dilution jets 110. More specifically, the number of impingement jets 140 and dilution jets 110 are selected to ensure that the pressure differential across impingement holes 140 in outer and inner supports 42 and 46, respectively, approximately matches the pressure differential across the film cooling openings 160 and across dilution openings 120, 122, 124, and 130.

During operation, impingement cooling air is directed through impingement jets 140 towards outer and inner liners 40 and 44, respectively, for impingement cooling of liners 40 and 44. The cooling air is also channeled through dilution jets 110 and through film cooling openings 160 into combustion chamber 54. More specifically, airflow discharged from openings 160 facilitates film cooling of liners 40 and 44 such that an operating temperature of each is reduced. Airflow entering chamber 54 through jets 110 facilitates radially and circumferentially cooling a temperature of the combustor flow path such that a desired exit temperature distribution is obtained. As such, the reduced combustor operating temperatures facilitate extending a useful life of combustor 16 and the desired exit temperature distribution facilitates extending a useful life to turbine hardware downstream of combustor 16.

The above-described dilution and impingement jets provide a cost-effective and reliable means for operating a combustor. More specifically, each support includes a plurality of impingement jets that channel cooling air radially inward for impingement cooling of the combustor outer and inner liners. The outer and inner liners each include a plurality of dilution jets and film cooling openings which channel air inward into the combustion chamber. As a result, at least some of the impingement cooling air film cools the liners, and the remaining impingement cooling air is directed inward to facilitate radially and circumferentially cooling the combustor flow path such that a desired exit temperature distribution is obtained.

An exemplary embodiment of a combustion system is described above in detail. The combustion system components illustrated are not limited to the specific embodiments described herein, but rather, components of each combustion system may be utilized independently and separately from other components described herein. For example, the impingement jets and/or dilution jets may also be used in combination with other engine combustion systems.

While the invention has been described in terms of various specific embodiments, those skilled in the art will recognize that the invention can be practiced with modification within the spirit and scope of the claims.

What is claimed is:

1. A method for assembling a combustor for a gas turbine engine, said method comprising:

coupling an inner liner to an outer liner such that a combustion chamber is defined therebetween;

positioning an outer support a distance radially outward from the outer liner;

positioning an inner support a distance radially inward from the inner liner;

forming at least two rows of impingement openings extending through at least one of the inner support and the outer support for channeling impingement cooling air therethrough towards at least one of the inner liner and the outer liner; and forming at least one row of dilution openings extending through at least one of the inner liner and the outer liner for channeling dilution cooling air therethrough into the combustion chamber, such that a pressure differential across the at least two rows of impingement openings is substantially equal to a pressure differential across the at least one row of dilution openings.

2. A method in accordance with claim 1 wherein forming at least one row of dilution openings further comprises:

forming a row of first primary dilution openings that each have a first diameter; and forming a row of second primary dilution openings that each have a second diameter that is larger than the first diameter of the first primary dilution openings.

3. A method in accordance with claim 2 wherein forming a row of second primary dilution openings further comprises forming the row of second primary dilution openings such that each of the second primary dilution openings is between a pair of adjacent first primary dilution openings.

4. A method in accordance with claim 1 further comprising forming a plurality of film cooling openings extending through at least one of said inner liner and said outer liner for channeling cooling air for film cooling of at least one of said inner liner and said outer liner, wherein the plurality of film cooling openings are in flow communication with the at least two rows of impingement openings.

5. A combustor for a gas turbine engine, said combustor comprising:

an inner liner;

an outer liner coupled to said inner liner to define a combustion chamber therebetween, at least one of said outer liner and said inner liner comprises a plurality of film cooling openings extending therethrough;

an outer support radially outward from said outer liner such that an outer passageway is defined between said outer support and said outer liner; and an inner support radially inward from said inner liner such that an inner passageway is defined between said inner support and said inner liner, at least one of said inner support and said outer support comprising at least two, rows of impingement openings arranged in an array and extending therethrough for channeling impingement cooling air towards at least one of said inner liner and said outer liner, at least one of said inner liner and said outer liner comprising at least one row of dilution openings extending therethrough for channeling dilution cooling air into said combustion chamber, a pressure differential across said at least two rows impingement openings is substantially equal to a pressure differential across said at least one row of dilution openings and said plurality of film cooling openings.

6. A combustor in accordance with claim 5 wherein said at least one row of dilution openings facilitate radially and circumferentially reducing exit flow temperatures from said combustor.

7. A combustor in accordance with claim 5 wherein said at least one row of dilution openings further comprises a row of first primary dilution openings having a first diameter, and a row of second primary dilution openings having a second diameter that is larger than said first diameter.

8. A combustor in accordance with claim 7 wherein said combustor comprises an equal number of said first primary dilution openings and said second primary dilution openings.

9. A combustor in accordance with claim 7 wherein each said second primary dilution opening is between a pair of adjacent said first primary dilution openings.

10. A combustor in accordance with claim 7 wherein at least one of said inner liner and said outer liner further comprises a plurality of film cooling openings extending therethrough for channeling cooling air for film cooling of at least one of said inner liner and said outer liner.

11. A gas turbine engine comprising a combustor comprising at least one injector, an inner liner, an outer liner, an outer support, and an inner support, said inner liner coupled to said outer liner to define a combustion chamber therebetween, said inner and outer liners further defining a dome opening, said injector extending substantially concentrically through said dome opening, said outer support spaced radially outward from said outer liner, said inner support spaced radially inward from said inner liner, at least one of said inner support and said outer support comprising at least two rows of impingement openings arranged in an array and extending therethrough for channeling impingement cooling air towards at least one of said inner liner and said outer liner, at least one of said inner liner and said outer liner comprising at least one row of dilution openings extending therethrough for channeling dilution cooling air into said combustion chamber, said at least one row of dilution openings comprises at least a row of first primary dilution openings and a row of second primary dilution openings, each of said second primary dilution openings is downstream from and between each of said first primary dilution openings.

12. A gas turbine engine in accordance with claim 11 wherein said combustor at least one row of dilution openings facilitate radially and circumferentially controlling distortion in exit flow temperatures from said combustor.

13. A gas turbine engine in accordance with claim 12 wherein a number of said first primary dilution openings is equal to a number of said combustor second primary dilution openings.

14. A gas turbine engine in accordance with claim 12 wherein each of said first primary dilution openings has a first diameter that is smaller than a second diameter of each of said second primary dilution openings.

15. A gas turbine engine in accordance with claim 14 wherein each said combustor second primary dilution opening is between a pair of adjacent said first primary dilution openings.

16. A gas turbine engine in accordance with claim 14 wherein said combustor further comprises a plurality of air swirlers, each said combustor first primary dilution opening is aligned downstream from, and are positioned substantially co-axially with respect to a centerline of each said air swirler.

17. A gas turbine engine in accordance with claim 12 wherein at least one of said inner liner and said outer liner further comprises a plurality of film cooling openings for channeling cooling air therethrough for film cooling at least one of said inner liner and said outer liner.

18. A gas turbine engine in accordance with claim 17 wherein a pressure differential across said combustor array of impingement openings is substantially equal to a pressure differential across said at least one row of dilution openings and said plurality of film cooling openings.

* * * * *